US006203138B1

(12) United States Patent
Hirabayashi et al.

(10) Patent No.: US 6,203,138 B1
(45) **Date of Patent: *Mar. 20, 2001**

(54) METHOD OF EXCHANGING WASTE INK PACK OF INK JET RECORDING APPARATUS

(75) Inventors: Hiromitsu Hirabayashi; Hiroshi Tajika, both of Yokohama; Miyuki Matsubara, Tokyo; Noribumi Koitabashi, Yokohama; Atsushi Arai, Yokohama; Shinji Kanemitsu, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/976,231

(22) Filed: Nov. 21, 1997

Related U.S. Application Data

(62) Division of application No. 08/681,495, filed on Jul. 23, 1996, now Pat. No. 5,745,134, which is a continuation of application No. 08/573,754, filed on Dec. 18, 1995, now abandoned, which is a continuation of application No. 08/264,755, filed on Jun. 23, 1994, now abandoned, which is a continuation of application No. 07/945,608, filed on Sep. 16, 1992, now abandoned, which is a division of application No. 07/873,655, filed on Apr. 23, 1992, now Pat. No. 5,172,140, which is a continuation of application No. 07/711,756, filed on Jun. 7, 1991, now Pat. No. 5,180,373.

(30) Foreign Application Priority Data

| | | |
|---|---|---|
| Jun. 13, 1990 | (JP) | 2/152609 |
| Sep. 28, 1990 | (JP) | 2/259164 |
| Jan. 18, 1991 | (JP) | 3/4398 |

(51) Int. Cl.[7] ..... B41J 2/165

(52) U.S. Cl. ..... 347/36; 347/29; 347/35

(58) Field of Search ..... 347/36, 35, 29, 347/31; 400/7.01; 15/256.5

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,695,851 | * | 9/1987 | Terasawa | 347/36 |
| 4,701,771 | | 10/1987 | Ikeda | 346/140 R |
| 4,723,129 | | 2/1988 | Endo et al. | 346/1.1 |
| 4,740,796 | | 4/1988 | Endo et al. | 346/1.1 |
| 4,814,794 | | 3/1989 | Sato | 346/140 R |

(List continued on next page.)

FOREIGN PATENT DOCUMENTS

| | | | | |
|---|---|---|---|---|
| 57-63285 | | 4/1982 | (JP) | B41J/27/00 |
| 4-344257 | * | 11/1992 | (JP) | 347/36 |

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

An ink jet recording apparatus includes a plurality of ink jet recording heads for executing color recording, a recovery structure for maintaining and recovering a discharge state with respect to the plurality of recording heads, and a waste ink collecting container for collecting waste ink discharged from the recovery structure. The recovery structure has a plurality of waste ink collecting routes to the collecting container in accordance with each of the plurality of recording heads, and the plurality of waste ink collecting routes are disposed so as to discharge a predetermined kind of waste ink and other plural kinds of waste ink to different portions of the collecting container, respectively.

4 Claims, 14 Drawing Sheets

U.S. PATENT DOCUMENTS

| | | | | |
|---|---|---|---|---|
| 4,901,094 | | 2/1990 | Iwagami et al. | 346/140 R |
| 4,965,596 | * | 10/1990 | Nagoshi et al. | 347/36 |
| 5,113,206 | | 5/1992 | Fukazawa | 346/140 R |
| 5,172,140 | | 12/1992 | Hirabayashi et al. | 346/140 R |
| 5,221,935 | | 6/1993 | Uzita | 346/140 R |
| 5,237,341 | | 8/1993 | Iwagami et al. | 346/140 R |
| 5,245,362 | * | 9/1993 | Iwata et al. | 347/36 |
| 5,757,399 | * | 5/1998 | Murayama et al. | 347/36 |

* cited by examiner

METHOD OF EXCHANGING WASTE INK PACK OF INK JET RECORDING APPARATUS

This application is a division of application Ser. No. 08/681,495 filed Jul. 23, 1996, now U.S. Pat. No. 5,745,134, which is a continuation of application Ser. No. 08/573,754 filed Dec. 18, 1995, now abandoned, which is a continuation of application Ser. No. 08/264,755 filed Jun. 23, 1994, now abandoned, which is a continuation of application Ser. No. 07/945,608 filed Sep. 16, 1992, now abandoned, which is a division of application Ser. No. 07/873,655 filed Apr. 23, 1992, now U.S. Pat. No. 5,172,140, which is a continuation of application Ser. No. 07/711,756 filed Jun. 7, 1991, now U.S. Pat. No. 5,180,373.

BACKGROUND OF THE INVENTION

1. Field of the Invention

The present invention relates to an ink jet recording apparatus incorporating a recording head which discharges ink from a discharge opening so as to record desired information. More particularly, the present invention relates to an ink jet recording apparatus having a waste ink collecting section for collecting waste ink cleared by a recovery means which maintains and recovers excess ink from the recording head.

2. Description of the Related Art

Ink jet recording apparatus having a discharge recovery function for maintaining and recovering excess ink cleared from a recording head are known. During the recovering operation, ink is cleared from the discharge opening in the recording head without being used for recording. In most of the known apparatuses of the type described, the waste ink cleared from the discharge opening is collected in a waste ink collecting section through tubing or the like and is then discarded.

Hitherto, various types of waste ink collecting systems have been proposed. For instance, a system has been proposed in which the waste ink is discharged into a disposable tray which can be removed from the apparatus and discarded. Another known system employs a waste ink reservoir which is replaceably mounted in the apparatus and which is provided with an ink absorber. In still another known system, the waste ink is returned to a waste ink reservoir integrated with the ink cartridge which stores the fresh ink that is supplied to the recording head.

In the system which employs the waste ink reservoir, it is necessary to change the reservoir as stated above, since the volume of the waste ink in the reservoir increases whenever the ink is cleared. In a system of the type in which the waste ink reservoir is integrated with the ink cartridge, the ink cartridge and, hence, the waste ink reservoir are changed each time the fresh ink supply for recording is exhausted, regardless of the amount of waste ink present in the waste ink reservoir.

Other proposals include a waste ink collecting system having a waste ink reservoir with a volume large enough to contain the total amount of waste ink which is expected to be generated during a possible period of operation of the recording apparatus, and a waste ink collecting system having means for sensing the amount of waste ink in an waste ink reservoir which signals the user that it is necessary to change the waste ink reservoir, thus enabling the reservoir to be changed at suitable intervals.

These known waste ink collection systems, however, suffer from the following disadvantages.

Namely, in the system of the type in which the waste ink reservoir is replaced together with the ink cartridge regardless of the amount of the waste ink collected in the reservoir, problems arise because reservoir may hold either very little or too much waste ink when the fresh ink in the reservoir has been consumed. In the former case, the waste ink reservoir is replaced unnecessarily, whereas, in the latter case, the recorded image and/or the operator's hand may become dirty should the waste ink reservoir overflow or leak waste ink. In the worst case, the operation of the recording apparatus itself may be impeded because of the waste ink leaking from the reservoir.

The collection system having a waste ink reservoir large enough to contain the total quantity of waste ink expected to be generated throughout the entire life of the recording apparatus is also impractical because the size and the cost of the apparatus are increased due to extremely large size of the waste ink reservoir needed. In addition, since the total amount of the waste ink which can be stored is still limited, flooding of the waste ink and the ensuing contamination of the apparatus may still take place when there is excessive usage, for example, when there is an increase in the volume of the wasted ink due to operator error.

The aforementioned system which is able to sense the amount of waste ink collected in the waste ink reservoir has been proposed to obviate these problems. In one version of this system, means is provided for preventing operation of the recording apparatus unless the waste ink reservoir is changed once the reservoir is filled up with the waste ink. This improved system is widely used because of its high reliability in regard to the handling of the waste ink.

Various other methods, such as methods for sensing the pressure or weight or optically sensing the level of collected waste ink have been proposed to enable sensing the volume of the waste ink stored in the waste ink reservoir. These methods, however, require complicated sensing devices which not only raise the cost of the recording apparatus but also reduce the volume of the waste ink that can actually be collected in the ink reservoir because they occupy a considerable volume of space, with the result that the frequency with which the waste ink reservoir must be changed is increased undesirably.

SUMMARY OF THE INVENTION

Accordingly, an object of the present invention is to provide an ink jet recording apparatus which can monitor the amount of waste ink collected in a waste ink reservoir to indicate the proper time to change the reservoir, thus eliminating any contamination of the recorded images and apparatus by waste ink, thereby overcoming the above-described problems of the prior art.

Another object of the present invention is to provide an ink jet recording apparatus which can efficiently dispose of waste ink by making efficient use of the limited space inside the apparatus.

To these ends, according to one aspect of the present invention, there is provided an ink jet recording apparatus of the type having a recording head provided with at least one discharge opening from which an ink is discharged, recovery execution means for clearing a predetermined amount of ink from the discharge opening to avoid any discharge failure of the recording head, and waste ink receiving means for receiving the waste ink cleared from the discharge opening, the apparatus comprising a recovery control section which includes: counting means for counting the cumulative number of times that an ink clearing operation has been performed by the recovery execution means; memory means for storing the cumulative number of times that the ink clearing operation has been counted by the counting means; comparing means for comparing, before beginning the ink clearing operation, the cumulative number of times stored in the memory means with a predetermined upper limit data indicating the maximum permissible number of times that the ink clearing operation can be performed, determined with respect to the capacity of the waste ink receiving means; and control means for producing, when the comparison shows that the cumulative number of ink cleaning operations performed exceeds the upper limit data, a changing signal for alerting a user that the waste ink receiving means has to be changed.

According to another aspect of the present invention, there is provided an ink jet recording apparatus of the type having a recording head provided with at least one discharge opening from which ink is discharged, recovery execution means for clearing a predetermined amount of ink from the discharge opening to avoid any discharge failure of the recording head, and waste ink receiving means for receiving the waste ink cleared from the discharge opening, the apparatus comprising an ink recovery control section which includes: counting means for counting the cumulative number of ink clearing operations performed by the recovery execution means; memory means for storing the cumulative number of times that the ink cleaning operation has been counted by the counting means; comparing means for comparing, before beginning the ink clearing operation, the cumulative number of times stored in the memory means with a predetermined upper limit data indicating the maximum permissible number of times that the ink clearing operation can be performed, determined with respect to the capacity of the waste ink receiving means, the comparing means being adapted to compare, when the cumulative number of ink clearing operations performed is smaller than the upper limit data, the cumulative number with a data representing a predetermined number of times that the ink clearing operation has been performed, after which a changing preparation signal is produced to indicate a need to prepare to change the waste ink receiving means; and control means for producing, when the comparison performed by the comparing means shows that the cumulative number of times exceeds the upper limit data, a changing signal for advising that the waste ink receiving means has to be changed, the control means also being adapted to generate the changing preparation signal when the comparison performed by the comparing means shows that the cumulative number of times is below the upper limit data but above the data representing the number of times at which the changing preparation signal is given.

According to the invention, the cumulative number of ink clearing cycles, i.e., the number of cycles of the ink clearing operation performed, is compared with an upper limit data which indicates the permissible maximum number of times that the ink clearing operation can be performed which is previously determined in relation to the capacity of the waste ink reservoir in order to ascertain whether there is room for the waste ink which is to be discharged in the next ink clearing operation in the waste ink reservoir. If the cumulative number of executions of ink clearing operations is smaller than the upper limit data, the apparatus determines that the waste ink can be received and allows the ink clearing operation to be performed. Conversely, when the cumulative number of ink clearing operations would exceed the upper limit data, the apparatus determines that the waste ink reservoir can no longer accept waste ink and signals the user that the waste ink reservoir is full and a change is necessary. It is therefore possible to avoid overflow of the waste ink caused by ink clearing after the waste ink reservoir has been filled.

In a preferred form of the present invention, the cumulative number of ink clearing operations, while still less than the above-mentioned upper limit data, is compared with an upcoming change data indicative of the number of ink clearing operations at which the user should prepare to change the waste ink reservoir. The user, therefore, can replace the waste ink reservoir without delay when the waste ink changing signal is given when the cumulative number of ink clearing operations has reached the upper limit data.

The above and other objects, features and advantages of the present invention will become clear from the following description of the preferred embodiments taken in conjunction with the accompanying drawings.

DESCRIPTION OF THE PREFERRED EMBODIMENTS

Embodiments of the present invention will be described with reference to the accompanying drawings.

Throughout the drawings, like numerals denote like components or parts.

Figure 1:
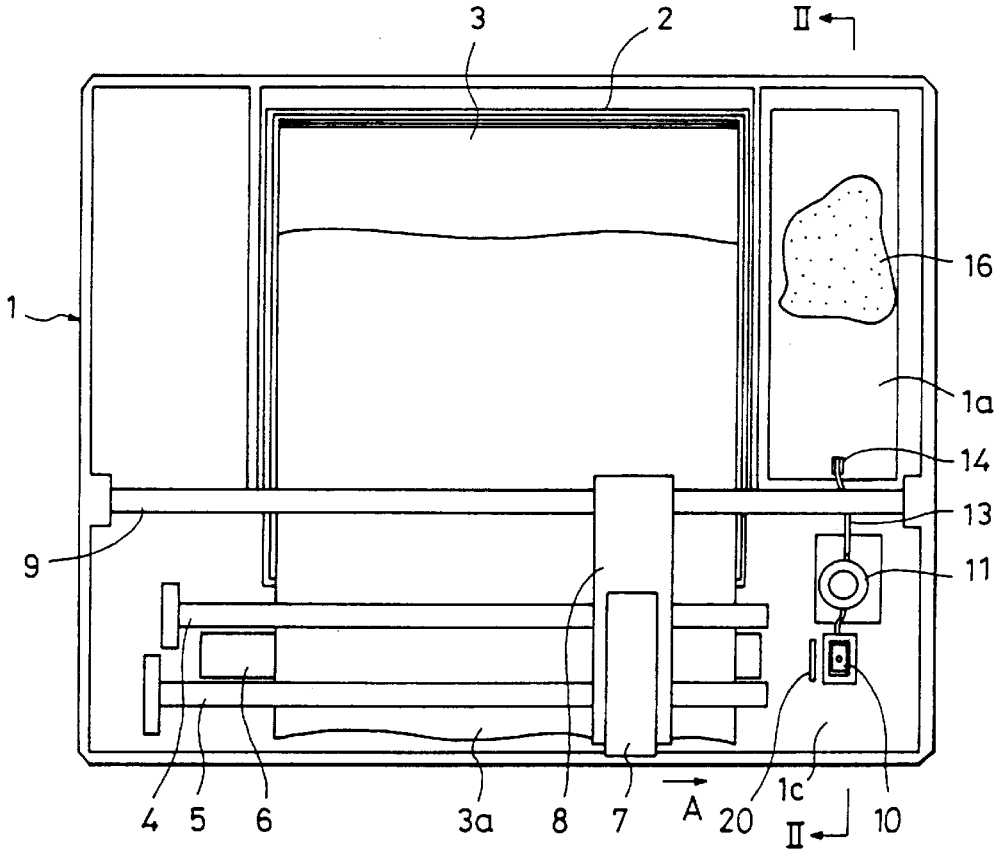
FIG. 1 is a schematic plan view of an embodiment of an ink jet recording apparatus designed in accordance with the present invention.
Figure 2:
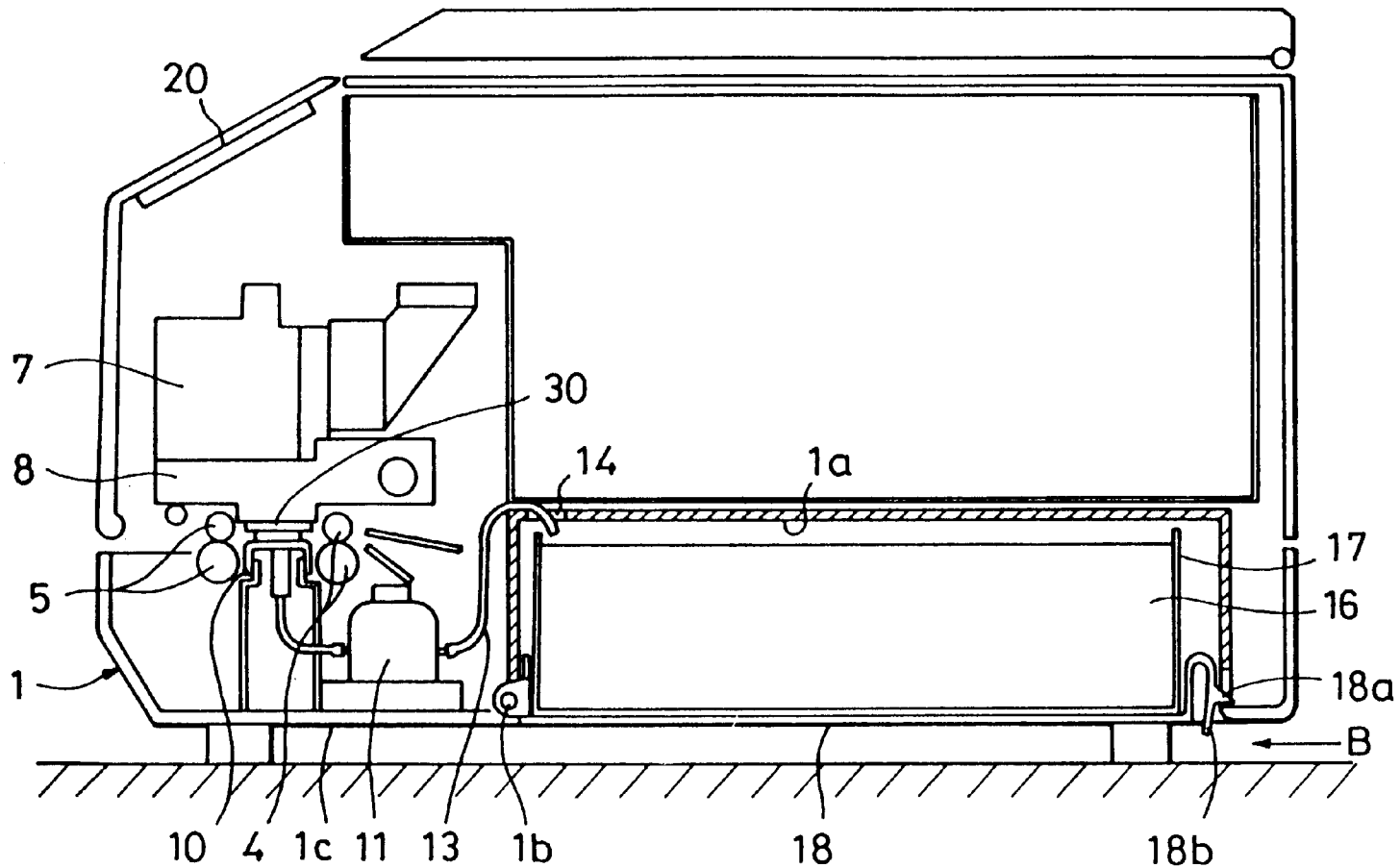
FIG. 2 is a sectional view taken along the line II—II of FIG. 1.

Referring to FIGS. 1 and 2 which show an embodiment of the ink jet recording apparatus of the present invention, the apparatus is provided at the center of a lower housing 1 thereof with a paper feeding cassette 2 on which are stacked sheets of recording medium 3 such as paper or plastic sheets.

The uppermost sheet 3*a* of the stack of the recording medium 3 is separated from the stack by a sheet feeder (not shown) and is fed into the recording medium conveyance path. The recording sheet of recording medium 3*a* is precisely advanced at a predetermined pitch through a recording section of the apparatus by a pair of sheet feeding rollers 4 which feed the recording medium by a predetermined distance and which cooperate with a pair of tension rollers 5 which apply tension to the recording medium so as to put the latter into close contact with the platen 6.

The recording head 7 is mounted on a carriage 8 which is reciprocably carried and guided by guide rails 9 laid on the housing 1.

The carriage 8 is adapted to move along the guide rails 9 transversely of the recording medium 3*a,* by the operation of a carriage motor which is not shown. During movement of the carriage 8, recording signals are input to the recording head 7 so that ink is discharged in accordance with the recording signals so as to be deposited on the recording medium 3*a* which is moved on the platen 6 past the region where it faces the recording head 7, whereby information is recorded on the recording medium 3*a* in accordance with the recording signals.

After completion of recording on a predetermined number of sheets of the recording medium, an ink clearing operation is executed for maintaining and recovering normal ink discharge performance of the recording head.

This ink clearing operation is conducted in the following manner. The carriage 8 is moved in the direction of the arrow A so as to bring the recording head 7 to a position where it faces a cap 10 disposed outside the recording region. Then, the discharge portion of the recording head is hermetically sealed by the cap 10, and a suction recovery pump 11 is activated to produce a vacuum inside the cap 10, whereby ink is forcibly sucked or cleared from the discharge opening of the recording head 7.

The waste ink collected by the recovery pump 11 is discharged through a tube 13 which leads to a waste ink disposal member 16 disposed in a waste ink receiving section 1*a,* through an opening 14 provided in the wall of the lower housing 1.

The waste ink receiving section 1*a* is supplied through a downwardly facing opening which is formed in what is an upward protrusion of the bottom wall 1*c* of the lower housing 1.

The interior structure of the waste ink receiving section 1*a* will be described with reference to FIG. 2.

The waste ink receiving section 1*a* is formed from an upward protrusion of the bottom wall 1*c* of the lower housing 1, i.e., upwardly recessing the bottom surface of the wall 1*c,* so as to open downwardly.

Thus, the peripheral walls and the top wall of the waste ink receiving section 1*a* are formed from the wall of the lower housing 1 and, hence, have sufficiently large mechanical strength.

A bottom cover 18 is secured to the underside of the lower housing 1 so as to be rotatable on a hinge 1*b* which is provided on the lower housing 1 so as to selectively open and close the open side, i.e., the lower side, of the recess forming the waste ink receiving section 1*a*.

The bottom cover 18 is provided with a latch 18*a* which is engageable with a portion of the lower housing 1 so as to hold the bottom cover 18 closed as shown in FIG. 2.

The latch 18*a* is provided at its one end with a finger plate 18*b*. As the finger plate 18*b* is pressed in the direction of the arrow B, latch 18*a* is elastically deformed so as to disengage from the lower housing 1, thus allowing the bottom cover 18 to pivot to an open position which allows access to the interior of the waste ink receiving section 1*a*.

A box-shaped waste ink pack 17 sized to fit within the waste ink receiving section 1*a* is placed on the bottom cover 18. A waste ink disposal member 16, which also will be referred to as "ink absorption member", is contained within the waste ink pack 17.

The waste ink pack 17 has a size which is receivable in the recess forming the waste ink receiving section 1*a*. The above-mentioned ink disposal member 16 is shaped and sized similarly to the waste ink pack 17 and is renewably disposed in the latter. For instance, the waste ink disposal member 16 is formed from a porous ink absorbing material, e.g., a sponge. Either one waste ink disposal member 16 can be kept in the waste ink pack 17 or, alternatively, a stack of a plurality of thin web-like ink absorption members 16 may be used.

The recording head 7 is an ink jet recording head which prints an ink by using thermal energy. To this end, the recording head 7 is equipped with an electro-thermal converting element.

In operation, an electric recording signal is applied to the electro-thermal converting element so that the electro-thermal converting element produces thermal energy. The thermal energy thus generated causes film boiling of the ink in the recording head so that a bubble (or void) of the ink is generated and then collapses in a controlled manner so as to generate a change in the ink pressure, whereby the ink is expelled from the discharge opening in the recording head to perform recording on the recording medium.

Figure 3:
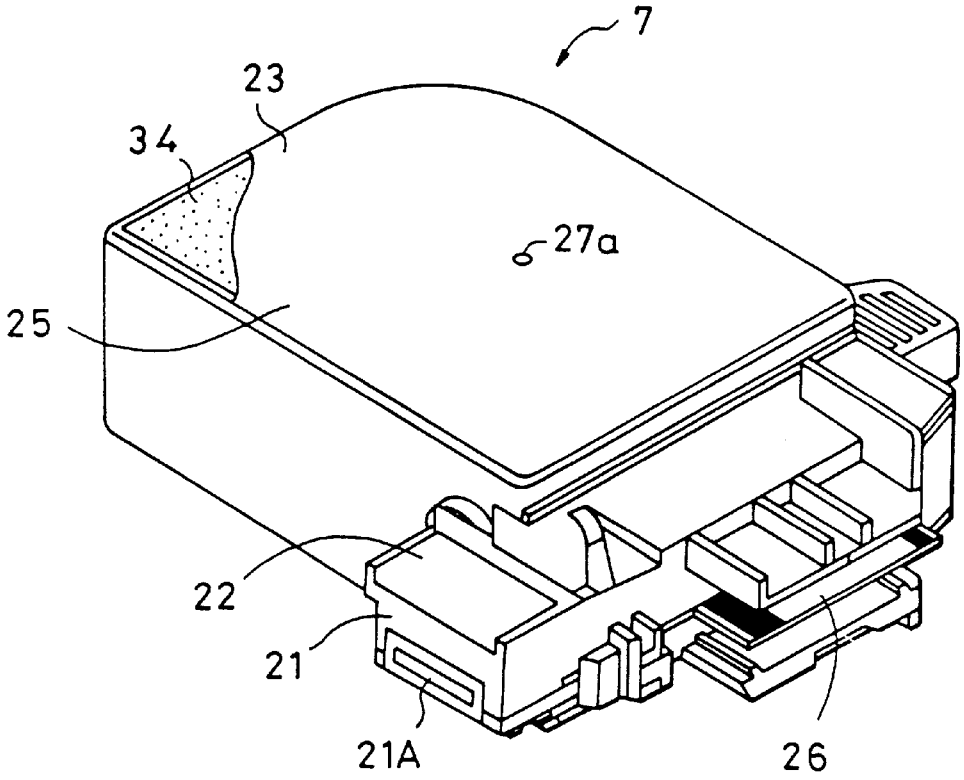
FIG. 3 is a schematic illustration of a recording head mounted in a recording apparatus of the present invention.

As will be seen from FIG. 3, the recording head 7 has a discharge portion 21 facing the recording medium 3 and having a plurality of discharge openings 21A, and a supply tank portion 22 serving as a sub-tank to which the ink is supplied from the aforementioned ink tank 23 and from which the ink is supplied to the discharge portion 21.

Figure 4:
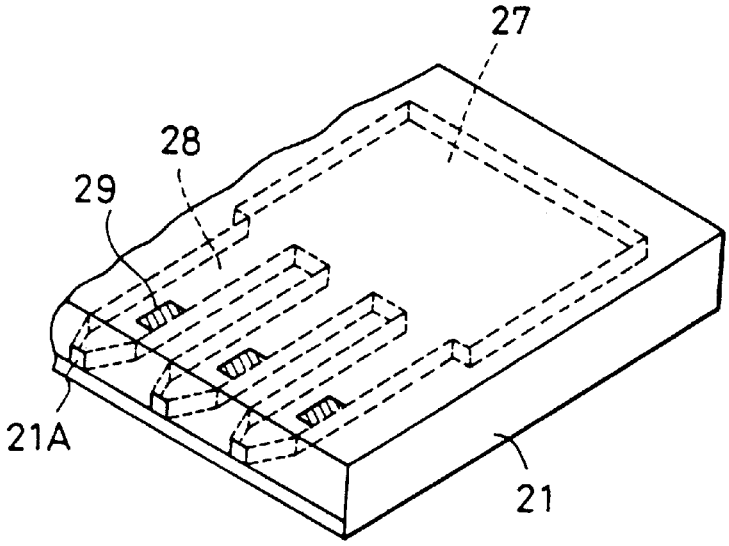
FIG. 4 is an enlarged schematic illustration of a recording head mounted on a recording apparatus of the present invention.

As shown in FIG. 4, the discharge portion 21 has a common ink chamber 27 which is supplied with ink from supply tank 22 and ink paths 28 connected in common in chamber 27 with the respective discharge openings 21A. Each ink path 28 is provided with an electro-thermal transducer 29 which functions as an electro-thermal converting element which generates energy for discharging the ink.

In operation, discharge signals corresponding to image data to be recorded are supplied from a print control section (not shown) to the recording head 7 through a cable and head terminals (not shown). Each electro-thermal transducer 29 is driven in accordance with the discharge signals to generate heat, whereby the ink is energized and discharged.

As will be seen from FIG. 3, the ink tank 23 accommodates an ink absorption member 34 which is made of a porous or a fibrous material and which is impregnated with the ink. The ink tank 23 is hermetically sealed by a cover member 25 but is ventilated through an air vent 27*a* so as to ensure a smooth supply of the ink. A pair of pins (not shown) which serve as electrodes for detecting the amount of the ink remaining in the ink tank 23 is disposed in the ink tank 23 at a predetermined spacing, such that the ends of these pins penetrate the ink absorption member 34.

In this embodiment, when the recording is not being conducted, the recording head 7 is adapted to be stationed at a home position which is provided on the right stroke end of the carriage 8, i.e., on the right end of the guide rails 9 shown in FIG. 1. The aforementioned cap member 10 is disposed at the home position so as to cover the surface of the recording head 7 having the discharge openings, thereby preventing evaporation and subsequent solidification of the ink in and around the discharge openings 21A. As explained before, pump 11 is connected to the cap 10 through a tube 13. When a discharge failure has occurred, interferring with printing, or whenever prevention of discharge failure is deemed necessary, the pump is activated to clear the residual ink from the discharge openings 21A. Thus, in the illustrated embodiment, the ink clearing operation is conducted by using the pump to apply suction which clears any voids or bubbles present in the discharge openings 21A and ink paths 28, as well as viscous or dried ink in discharge openings which results when the ink has not been used frequently. The ink cleaning operation also is conducted as a preventive measure in order to avoid any discharge failure, which may be caused by the presence of such voids, bubbles or viscous or dried ink. A blade 20 is provided on one side of the cap member 10 so as to project or be projectable into the path of movement of the recording head 7, thereby wiping the surface of the recording head 7 having the discharge openings 21A after the ink cleaning operation, thus removing any wetting component, paper dust or other contaminant, from the surface of the recording head.

The pump 11 is provided with a flexible waste ink tube 13 which carries the ink cleared during the ink clearing operation into the waste ink pack 17.

As shown in detail in FIG. 2, the waste ink pack 17 has a container made of, for example, a resin and a waste ink absorption member 16 which is disposed in the container and which is made of a fibrous material such as felt or non-woven cloth or a porous material such as a urethane foam.

The ink absorption member 16 is adapted for absorbing and holding the waste ink so as to prevent the ink from leaking outside. As explained before, the ink absorption member 16 may be a single member or may be a stack of a thin web-like absorption members. The stack-type ink absorption member is advantageously used because it allows diffusion of the ink at the boundary surfaces of the members so as to enable the whole volume of the absorption member to be used in absorbing and holding the ink. The end of the tube 13 is inserted into the waste ink pack 17 through an opening 14 formed in the upper wall of the container of the waste ink pack 17 so that the cleared waste ink is then carried into the pack 17. There is a practical limit in the volume of the waste ink which can be stored in the waste ink pack 17. In addition, the amount of the waste ink in the waste ink pack 17 increases whenever the ink cleaning operation is repeated. The waste ink pack 17 therefore needs to be changed by periodic replacement in accordance with a changing instruction given by a later-mentioned recovery control section to be described later. The waste ink pack 17 is detachably mounted on the recording apparatus by means of the following mounting structure.

Figure 5:
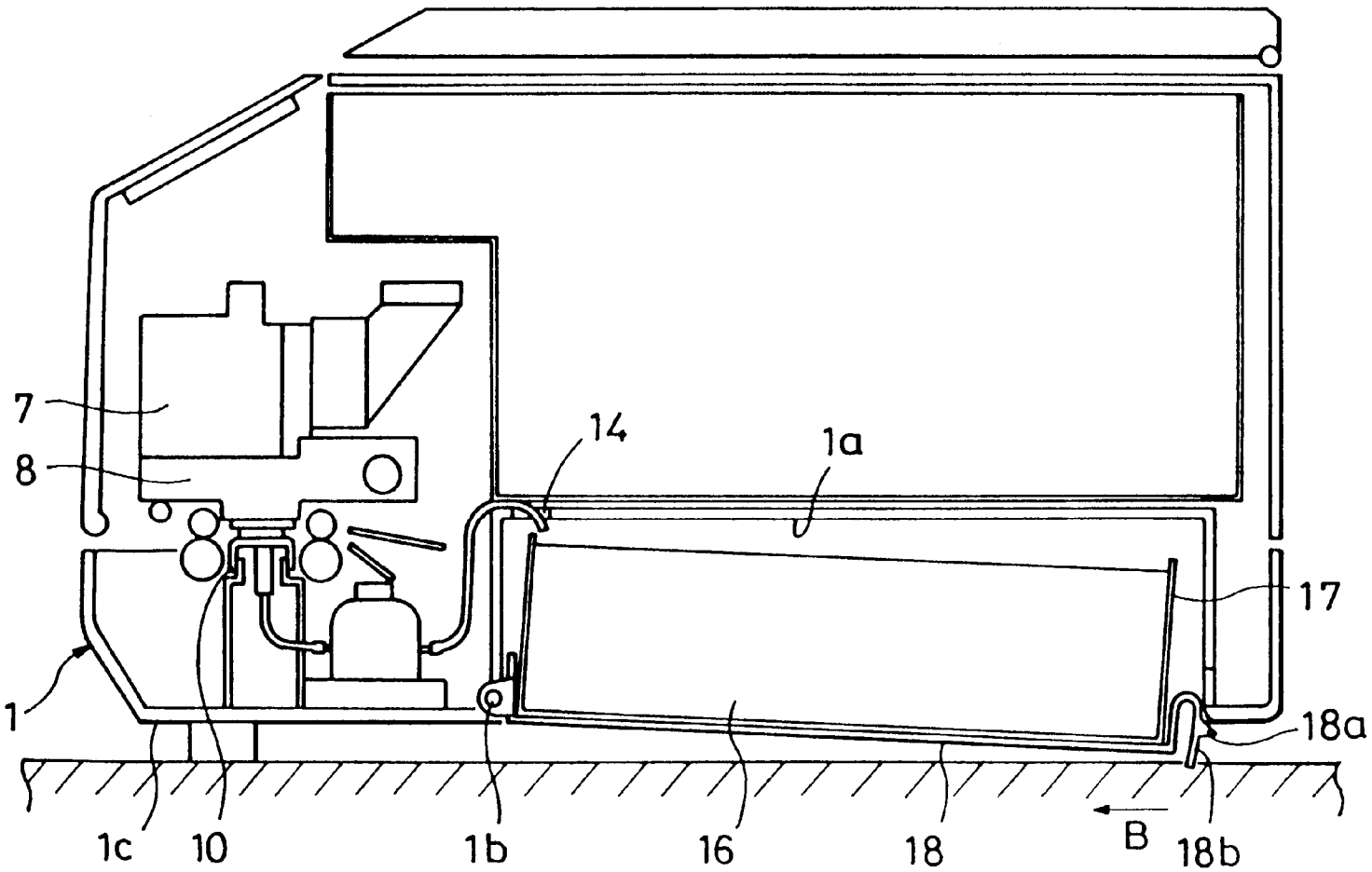
FIG. 5 is a sectional view of the apparatus taken along the same plane as FIG. 2, with a rear cover being removed.
Figure 6:
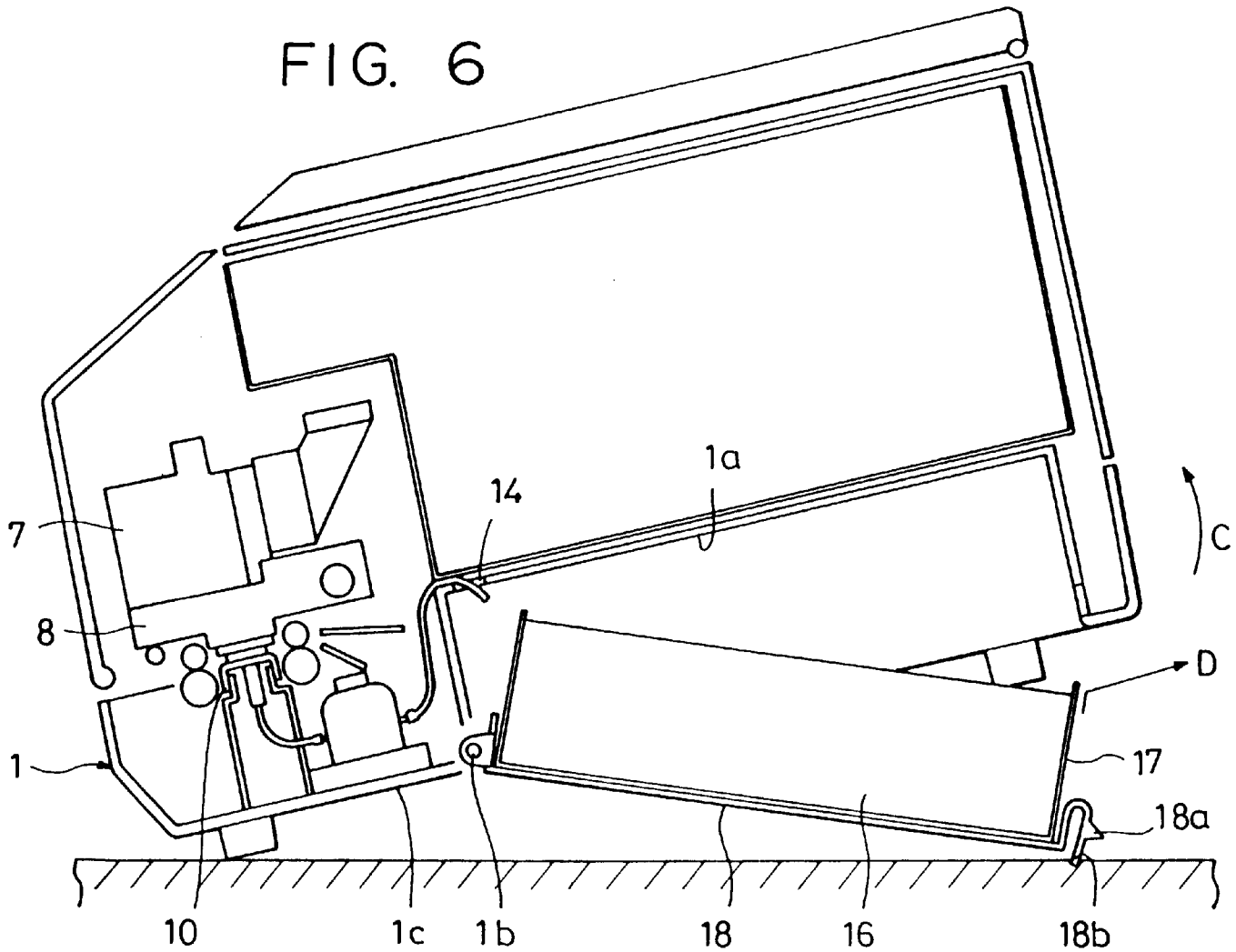
FIG. 6 is a schematic sectional view of the apparatus inclined from the position shown in FIG. 5.

The waste ink pack 17 is replaced as shown in a manner in FIG. 5. More specifically, FIG. 5 shows the recording apparatus with the bottom cover 18 released by disengaging latch 18*a*, while the recording apparatus is set in the ordinary state of use. FIG. 6 shows the state in which one end of the recording apparatus has then been raised from the state shown in FIG. 5 so as to be inclined.

The operation for replacing the waste ink disposal member 16 will be explained with specific reference to FIGS. 5 and 6. To change the waste ink disposal member 16, the finger retaining portion 18*b* is pressed in the direction of the arrow B so that the latch 18*a* is elastically deformed out of engagement with the lower housing 1.

As a result, the bottom cover 18 is rotated around the hinge 1*b* into abutment with the surface on which the recording apparatus is situated, as shown in FIG. 5.

Then, one end of the recording apparatus is lifted as shown in FIG. 6 so as to tilt the apparatus as shown by the arrow C, thus creating a space large enough to enable the waste ink pack 17 to be removed. The waste ink pack 17 is then withdrawn in the direction of the arrow D.

A new waste ink pack 17 containing an empty waste ink disposal member 16 is mounted by following the described steps in the reverse order.

In the described embodiment of the present invention, the waste ink receiving section 1*a* is provided in the recess formed in the lower side of the bottom wall 1*c* of the recording apparatus in order to make an efficient use of the space adjacent the space for accommodating the recording medium. It is therefore possible to provide a space for the waste ink receiving section 1*a* that has a fairly large volume without difficulty, by employing the unused space which has not been filled. It is therefore possible to offer a waste ink disposal member 16 having a large volume without reducing the strength of the lower housing 1 and, hence, remarkably reducing the frequency with which the waste ink disposal member 16 must be changed.

In the described embodiment of the ink jet recording apparatus of the present invention, means for alerting the user that it is necessary to change the waste ink pack is provided in the main part of the apparatus. The construction of such informing means will now be described in connection with the construction and operation of the recovery system.

Figure 7:
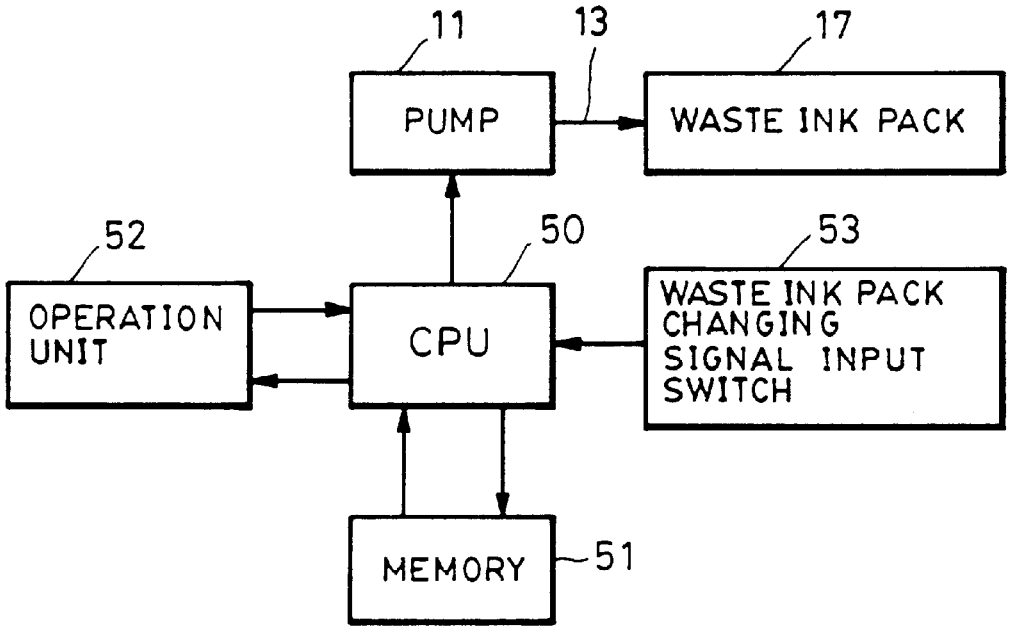
FIG. 7 is a block diagram showing the construction of one form of the recovery control section of the recording apparatus.

A description will be given first of the recovery control section for controlling the ink clearing operation, with reference to FIG. 7.

The recovery control section is composed of a CPU 50, a memory 51, an operation unit 52 and a waste ink pack changing signal input switch 53 (referred to as "change signal switch", hereinafter). When a recovery instruction for performing an ink cleaning operation under predetermined conditions is given from the operation unit 52, the CPU 50 determines whether the aforementioned waste ink pack 17 is to be changed. The CPU 50, if it determines that it is necessary to change the waste ink pack 17, provides a warning signal indicating the necessity of the change through the operation unit 52 and then initiates the ink cleaning operation including applying suction to remove the ink.

The memory 51 is composed of an EEPROM or an SRAM backed up by a battery, and stores the data K concerning the cumulative number of times that the ink cleaning operation has been performed and 1-bit change judgment data CM used in determining whether there is a need to change the waste ink pack 17. The change signal switch 53 is connected to the CPU 50 and is adapted to be turned on or off by the user when the ink pack 17 is cleaned so as to produce 1-bit data CS. More specifically, the change signal switch 53 produces signals of 0 level and 1 level when the change signal switch 53 is turned on and off, respectively. The operation unit 52 forms an input section for entering various control commands and includes an operation panel having the warning means such as a buzzer and other displays or indicators.

The ink cleaning operation performed by the recovery control section will be described with reference to the flow chart shown in FIG. 8.

In Step 61, a recovery instruction for beginning the clearing of ink from the recording head 7 is delivered by the operation unit 52. Subsequently, in Step 62, the contents of the memory 51 are checked to determine the cumulative execution number data K and the change judgment data CM are read from the operation unit 52. Subsequently, the CPU 50 compares the read change judgment data CM with the data CS set in the change information switch 53 to determine, m in Step 63, whether the waste ink pack 17 has been filled.

More specifically, in Step 63, the CPU determines the state of the the waste ink pack 17 in accordance with the following Table 1: namely, it determines that the waste ink pack 17 has not been changed when the condition CS=CM is met and produces a signal of the level "1", and determines that the waste ink pack was replaced in the previous ink clearing operation on condition of CS being not equal to CM and delivers a signal of "0" level.

When it has been determined that CS is not equal to CM, i.e., that the waste ink pack 17 has been changed (0), Step 68 is executed in which the cumulative number of times that the ink cleaning operation has been performed, data K, is reset to "0" and the change judgment data CM is updated to realize the condition of CS=CM in the memory 51.

TABLE 1

| Data CS set by change switch 53 | Change judgment data CM | Determination |
|---|---|---|
| 0 | 0 | 1 |
| 0 | 1 | 0 |
| 1 | 0 | 0 |
| 1 | 1 | 1 |

Thereafter, a reference to the memory 51 is conducted again to read the cumulative execution number data K and the change judgment data CM from the memory 51 and the data CS set by the change signal switch 53 is compared with the updated change judgment data CM. In this case, since the change judgment data CM has been updated in conformity with the condition of CS=M, the process proceeds to Step 64 in which the number of times that the ink clearing operation has been performed is determined.

Similarly, the process also proceeds to Step 64 when the comparison between the data CS set by the change signal switch 53 and the change judgment data CM conducted in Step 63 satisfies the condition CS=CM, i.e., when the waste ink pack 17 has not been changed (signal level 1).

The determination of the number of the times that the ink clearing operation has been performed in Step 64 is made by comparing the cumulative execution number data K of the ink clearing operations read from the memory 51 with the upper limit data F, which was previously determined in accordance with the capacity of the waste ink pack and which upper limit data F indicates the maximum number of times that the ink clearing operation can be repeated. If the comparison indicates that K is not less than F, the process proceeds to Step 69 in which a change signal is given to inform the operator that it is necessary to change the waste ink pack 17. This change signal may be given by, for example, activating the buzzer in the operation unit 52, together with energizing an indicator lamp or flashing an LED signalling the need to change the waste ink pack. The operator, seeing the change signal, then changes the waste ink pack 17 in Step 70, and changes over the change signal switch 53, so that the data CS set by the change signal switch 53 is now not equal to the change judgment data CM. The ink clearing operation is executed in Step 65 after the waste ink pack 17 has been changed.

Conversely, when the condition K<F is met as a result of the comparison performed in Step 64, the CPU 50 determines that the waste ink pack 17 is not full and so it can still receive additional waste ink discharged by the ink clearing operation to be executed, and the CPU therefore permits the ink clearing operation to be executed without requiring the waste ink pack to be changed.

After the ink clearing operation in the discharge recovery process has been completed, Step 66 is executed. The contents of the memory 51, which are indicative of the cumulative number K of ink cleaning operations performed, is incremented by 1, thus completing the discharge recovery process in Step 67.

The amount of the ink cleared in one cycle of the recovery process is between about 0.10 and 0.17 g (gram). In addition, in the case of a recording head having 128 nozzles, about 0.02 g of the ink per 5000 shots is discharged in each ink clearing operation. There are many modes for carrying out the recovery process depending on the state of the recording apparatus, such as timer-operated recovery mode, post-printing recovery mode, new cartridge mode, recovery conducted after a discharge failure has been detected, recovery after printing at high temperature, recovery triggered by operation of a recovery switch, and so forth. In some cases, two or more of these modes are executed in one printing cycle. Taking into account the repeated execution of the ink clearing recovery modes, the amount of ink cleared per cycle of printing, e.g., printing of 50 sheets of A-4 size, is estimated to be about 0.5 to 0.8 g at the greatest.

The amount of waste ink collected in the waste ink pack 17 increases with the number of executions of the recovery process. The amount of the ink however is also influenced by the environment in which the ink jet recording apparatus is used.

Figure 9:
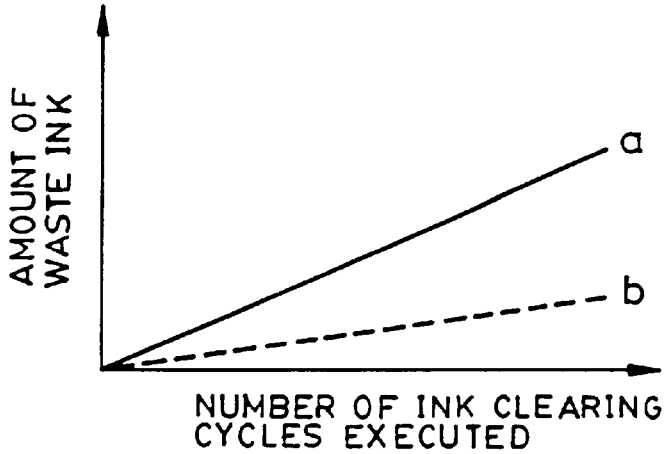
FIG. 9 is an illustration showing the increase in the amount of collected waste ink in relation to the number of ink clearing operations performed.

FIG. 9 shows the relationship between the number of times the discharge recovery process has been executed and the amount of waste ink collected as observed for two different environments. More specifically, the solid line a in this Figure shows the above-mentioned relationship as observed under conditions of normal temperature and humidity, while the dashed line b shows the relationship as observed under conditions of high temperature and low humidity. By comparing the curves a and b, it can be seen that less ink is collected in the waste ink pack 17 for conditions of high temperature and low humidity than for conditions of normal temperature and humidity. This is attributable to evaporation of the waste ink from the waste ink pack 17.

It is therefore advisable that the upper limit data F, which is used as the criterion for determining whether the waste ink pack has to be changed, be set not only on the basis of the volume of the waste ink pack 17 but also take into account the above-mentioned effects of environmental conditions, so that the frequency with which the ink pack 17 needs to be changed is minimized to enable a more efficient use of the waste ink pack 17.

Another embodiment of the ink clearing operation performed by the aforementioned recovery control section will now be described with specific reference to the flow chart shown in FIG. 10.

Figure 8:
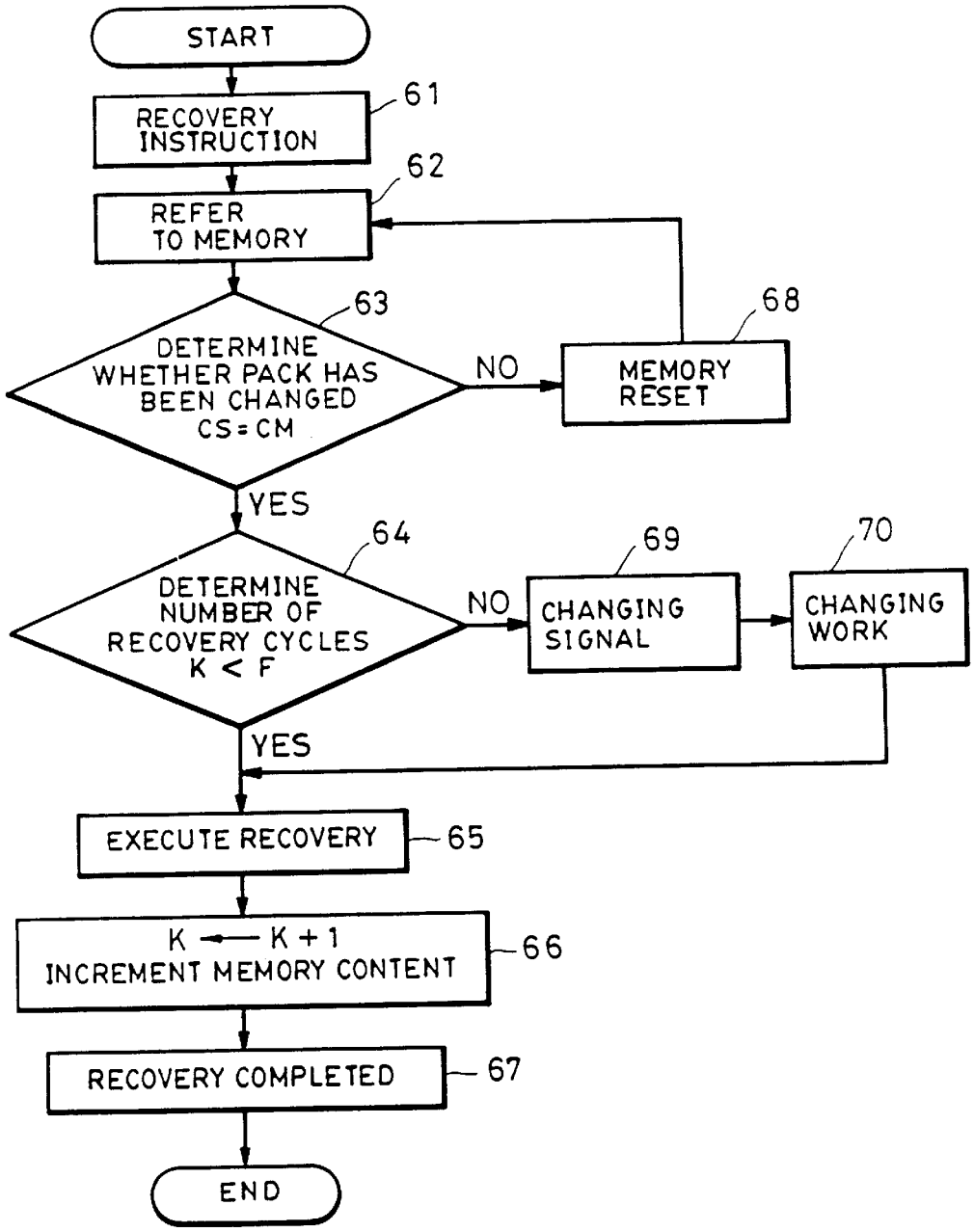
FIG. 8 is a flow chart illustrating how the ink clearing operation is performed by the recovery control section.
Figure 10:
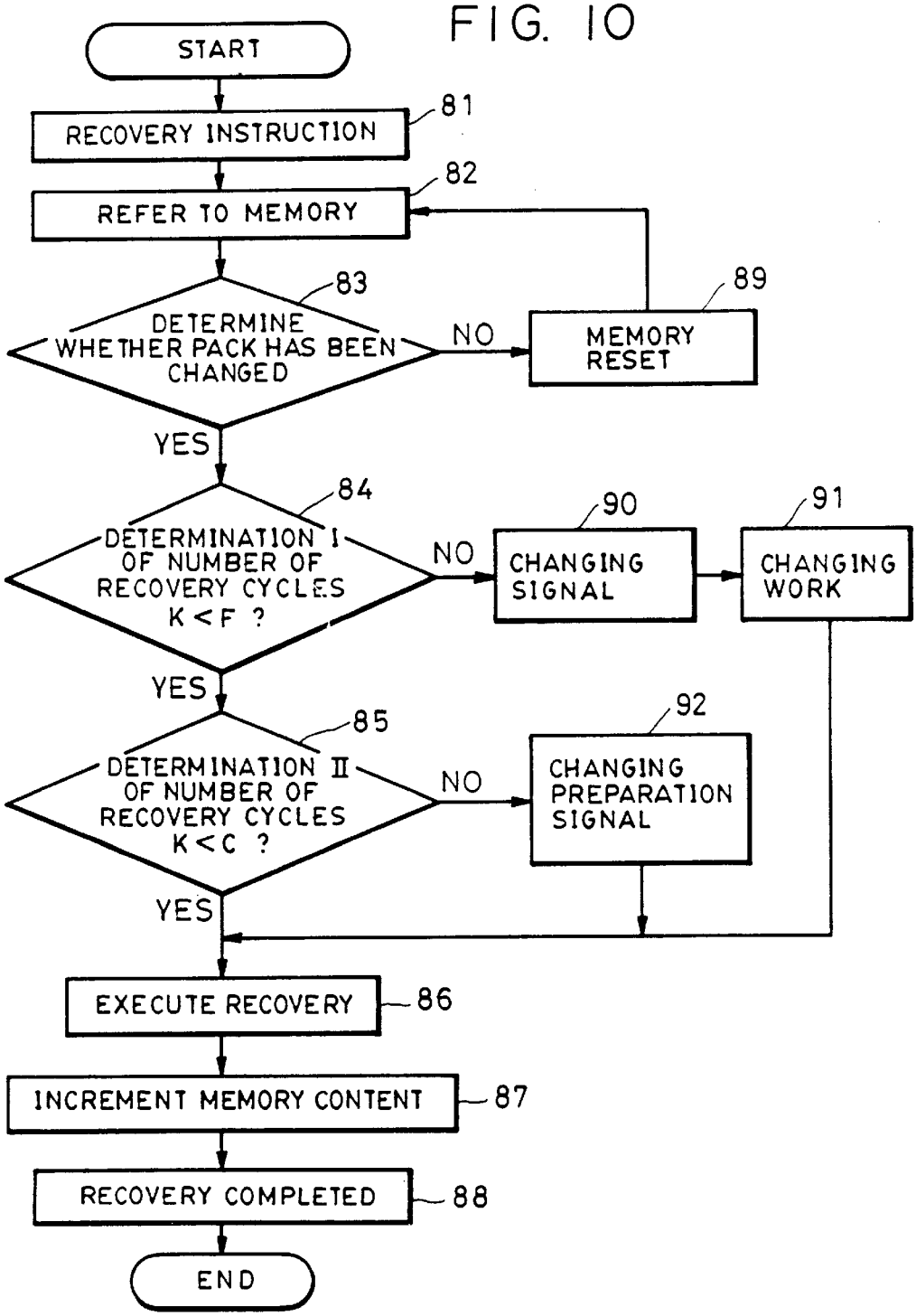
FIG. 10 is a flow chart showing another example of the ink clearing operations performed by the recovery control section.

The process shown in FIG. 10 differs from the process shown in FIG. 8 in that a changing preparation signal is given which enables the user to prepare to change the waste ink pack 17 before the waste ink pack 17 has become completely full.

In Step 84, a first determination I is conducted which compares the cumulative number K of times the ink clearing operation has been executed with upper limit data F. If the condition that K<F is met, i.e., when it is determined that it is not necessary to change the waste ink pack 17, the process proceeds to Step 85 in which a second determination II is made comparing the cumulative number data K with a number C which represents the number of recovery cycles at which time the changing preparation signal is to be given. If after the comparison conducted in Step 85 the condition K<C is not met, the process continues to Step 92 at which time a changing preparation signal is given to the user through the operation unit 52. The changing preparation signal is given through the operation unit 52 by, for example, activating a buzzer or the like together with flashing an indicator lamp or giving a message through a suitable display means.

The changing preparation signal enables the operator to ready a spare waste ink pack in preparation for the change. Thus, the user can change the waste ink pack without delay in Step 91 when the changing signal is given in Step 90. The changing preparation signal is issued for each recovery cycle so long as the condition C≦K<F is met.

Another embodiment of the ink jet recording apparatus of the present invention will now be described.

Figure 11:
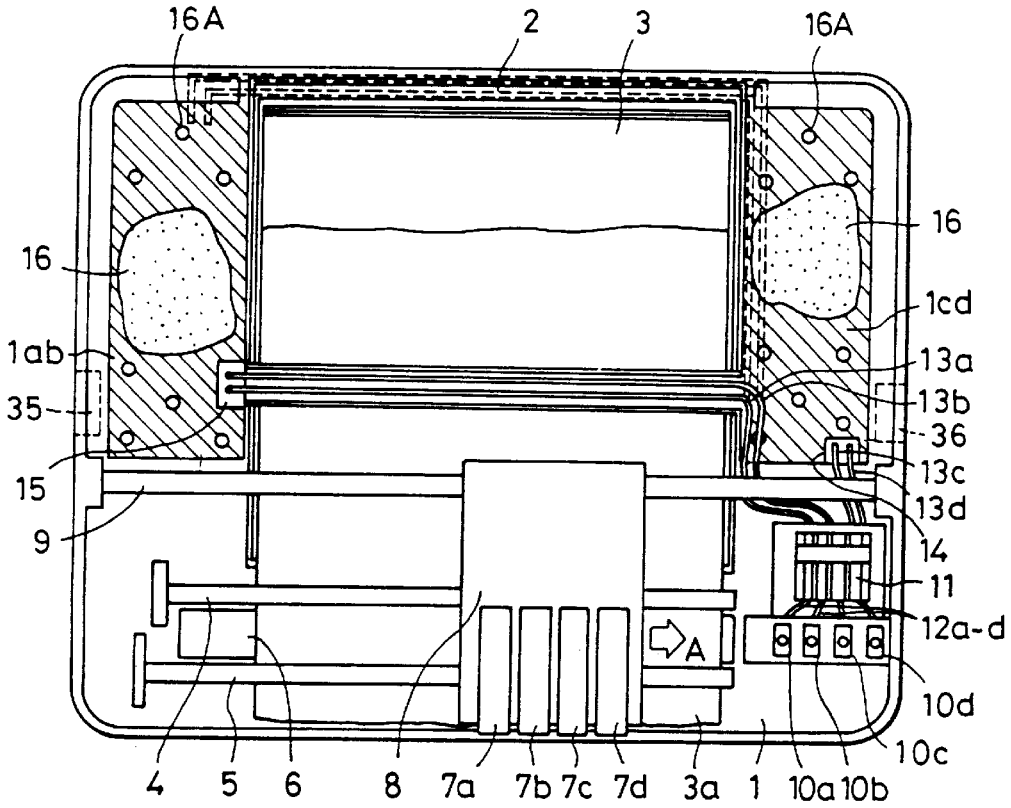
FIG. 11 is a schematic plan view of another embodiment of the ink jet recording apparatus of the present invention.

FIG. 11 is a plan view of an ink jet recording apparatus embodying the present invention. This ink jet recording apparatus is of the full-color type having changeable recording means for recording four colors, each recording means including an ink jet recording head and an ink tank integrated with each other. A cassette 2 on which sheets of paper 3 are stacked is mounted in the central region of the lower housing 1 of the apparatus. The uppermost paper sheet 3*a* is separated from the stack and fed into a sheet path by a paper feeder (not shown). The paper sheet is clamped between a pair of feed rollers 4 capable of feeding the paper sheet by a predetermined distance and also between a pair of tension rollers 5 which apply tension to the paper sheet to keep the paper sheet in close contact with the platen 6. A carriage 8 carries ink jet heads 7*a* to 7*d* corresponding to four colors such as black, cyan, magenta and yellow. The carriage is reciprocably moved on rails 9 in order to allow a full-color printing across the paper held by the platen 6. After recording on a predetermined number of sheets has been completed, the carriage 8 is moved in the direction of the arrow A to a home position where a recovery process is executed for the purpose of maintaining the ink jet heads in paper discharging condition. More specifically, ink jet heads 7*a* to 7*d* are capped with cap members 10*a* to 10*d* and pump 11 is activated to apply vacuum thereto in order to restore the paper discharging performance of these ink jet heads. In this embodiment, pump 11 is a tube pump having rotating roller for generating vacuum by its rotation pressing a part of tubes 12*a* to 12*d*. The cleared waste ink is fed into tubes 13*a* to 13*d*, the ends of which reach, via an opening 14 formed in the wall of a lower housing 1 of the apparatus, the waste ink disposal member 16 in a waste tank receiving section 1*cd* which is shown cross-hatched in FIG. 11. Similarly, the tubes 13*a* and 13*b* are extended, through a bridging portion of the lower housing 1 above the cassette 2 and via an opening 15, to lead cleared ink to a waste ink disposal member 16 contained in another waste ink receiving section 1*ab* which also is shown cross-hatched in FIG. 11. Because of the possibility of waste ink leaking around the above-mentioned bridging portion of the lower housing, the tubes 13*a* and 13*b* may instead be extended along the side walls of the cassette 2 of the recording medium, as shown by the dashed lines. The constructions of the waste ink receiving sections 1*ab* and 1*cd* are materially the same. In each recovery cycle the waste ink cleared from the ink jet heads 7*a* and 7*b* is collected in the waste ink receiving section 1*ab* and the ink cleared from the ink jet heads 7*c* and 7*d* is collected in the waste ink receiving section 1*cd*. Since the quantities of the inks cleared from the different ink jet heads are almost the same, both waste ink disposal members 16 absorb approximately the same amount of waste ink.

In this embodiment, handles 35 and 36 are provided on the lower housing 1 of the apparatus as indicated by the dashed lines. According to this arrangement, the apparatus remains balanced and can easily be lifted by the handles 35 and 36 even after both waste ink receiving sections have become full.

In this embodiment, the waste ink receiving sections are provided on both sides of the paper sheet feed path in a central area of the apparatus in order to maintain good weight balance. The waste ink receiving sections may, however, be arranged so that the receiving sections are provided on both longitudinal ends of the paper sheet feed path in order to keep the apparatus balanced in the longitudinal direction.

In this embodiment, black and cyan waste inks are collected in one of the waste ink receiving sections, while the magenta and yellow waste inks are collected in the other waste ink receiving section so as to keep balance in the amounts of inks in both waste ink receiving sections. In some recording apparatuses, however, recording is conducted mainly by printing characters in black color. In such a case, the ink jet head 7*a* for the black ink is used more frequently than the other ink jet heads, so that an independent suction pump is used specifically for the black ink jet head in order to conduct the recovery operation more frequently than is done for the other ink jet heads. As a consequence, the amount of black waste ink is much greater than that for those other color inks. In this case, it is advisable that the waste ink from the black ink jet head be collected in one of the waste ink receiving sections, while the waste ink from other three ink jet heads be collected in the other waste ink receiving sections.

Figure 12:
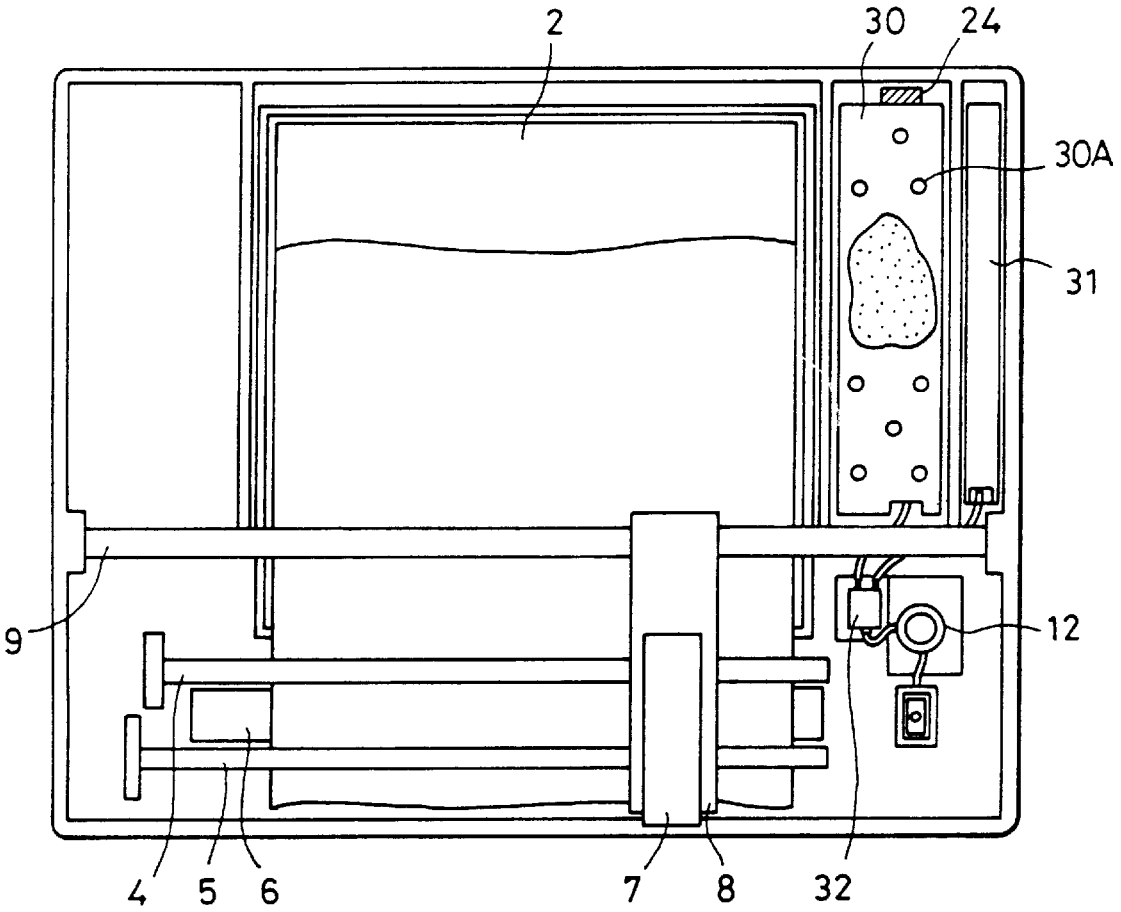
FIG. 12 is a schematic plan view of still another embodiment of the ink jet recording apparatus of the present invention.

FIG. 12 shows a modification of this embodiment having a plurality of waste ink receiving sections. This modification has a first waste ink receiving section 30 and a second waste ink receiving section 31. A flow path selecting means 32 having a change-over valve (not shown) is disposed in a line which leads from a suction pump 12 to the first waste ink receiving section 30 and the second waste ink receiving section 31. This flow path selection means 32 is usually set to allow the waste ink cleared by the suction pump 12 to be delivered to the first waste ink receiving section 30. The waste ink collected after repeated ink clearing operations is introduced into the first waste ink receiving section 30 until it becomes nearly full. When the level sensing circuit or separate ink amount sensor 24 detects that the first waste ink receiving section 30 is filled, the change-over valve of the flow path selecting means 32 is actuated to direct the waste ink to the empty second waste ink receiving section 31 so that recording can continue. This is an improvement over the arrangement which requires the waste ink absorption member to be replaced each time the waste ink receiving section becomes full. In the present embodiment, after the waste ink path has been switched, some of the solvent in the first waste ink receiving section 30 evaporates, lowering the level of the ink in this section 30. The sensor 24, detecting this drop in the ink level, generates a signal in response to which the change-over valve of the flow path switching means 32 once again causes the waste ink to flow into the first waste ink receiving section, thus enhancing the efficiency of use of the waste ink receiving sections.

In this embodiment, the recovery control section is capable of initiating the recovery operation for each of the recording heads 7*a,* 7*b,* 7*c* and 7*d* either independently or simultaneously.

For instance, the recovery control section can conduct the control of the recovery operation in the following manner. When the recovery operation is conducted independently for each of the ink jet heads 7*a,* 7*b,* 7*c* and 7*d,* the total number of ink clearing of recovery cycles conducted for each of the heads is monitored and the total number of recovery cycles for all the ink jet heads are added together to determine the total number K of ink clearing recovery cycles that have been executed. The total number K of ink clearing recovery cycles executed determined in this manner is compared with the aforementioned upper limit data F, which in this case represents the maximum number of individual ink cleaning recovery cycles that can be executed for the individual ink jet heads, thus determining whether or not the ink absorption member 16 has to be replaced.

In this embodiment, waste ink cleared from two recording heads 7*a,* 7*b* is collected in a waste ink receiving section, while ink from other two recording heads 7*c,* 7*d* is received by another waste ink receiving section or, alternatively, ink from all the recording heads is commonly received by the waste ink receiving sections 30 or 31. The embodiment, however, may be modified such that a waste ink pack is provided for each of the recording heads 7*a,* 7*b,* 7*c* and 7*d* and the number of ink clearing recovery cycles executed for each of the recording heads is counted independently so that it is possible to independently determine whether it is necessary to change the waste ink packs for each of the different color inks. In this case, the upper limit data F is determined as the upper limit of the number of recovery cycles which is allowed for a given volume of each waste ink pack.

Obviously, a single suction pump 11 may be commonly used for all the recording heads 7*a* to 7*d* so that all these heads are cleared of ink simultaneously. In this case, it can be determined whether there is a need to change the waste ink absorption member 16 by comparing the counted cumulative number of times that ink clearing operation has been performed with the upper limit data F which, in this case, is determined to be ¼ that of the upper limit data F used in the above-described case where the ink clearing operation is conducted independently for each of the recording heads. This modification provides an advantage in that the capacity required for the memory that stores the cumulative number of times the ink clearing operation has been executed can be reduced as compared with the case where the total number of times the ink clearing operation has been executed for all the recording heads 7*a* to 7*d.*

Although the embodiments described hereinbefore employ waste ink absorption or disposal member in the waste ink pack, the use of such a waste ink absorption or disposal member is not essential. Namely, the waste ink pack may contain only a waste ink container without an internal waste ink absorption or disposal member, provided that the ink jet recording apparatus is always kept level. In such a case, the waste ink tube 13 may be fitted in the opening 14 formed in the upper wall of the waste ink container so that the waste ink can flow into the container without fail. Preferably, the upper wall of the waste ink container is also provided with a vent hole 16A or 30A which allows evaporation of the waste ink solvent and prevents the internal pressure of the container from rising. Preferably, such vent holes 16A, 30A and the opening 14 are normally closed by caps.

As will be explained later, the waste ink receiving sections 1*ab* and 1*cd* in the embodiment shown in FIGS. 11 and 12 may employ waste ink packs 17 which are detachably connected to the lower housing 1, while the bottom cover 18 used in the first embodiment is omitted.

Figure 13:
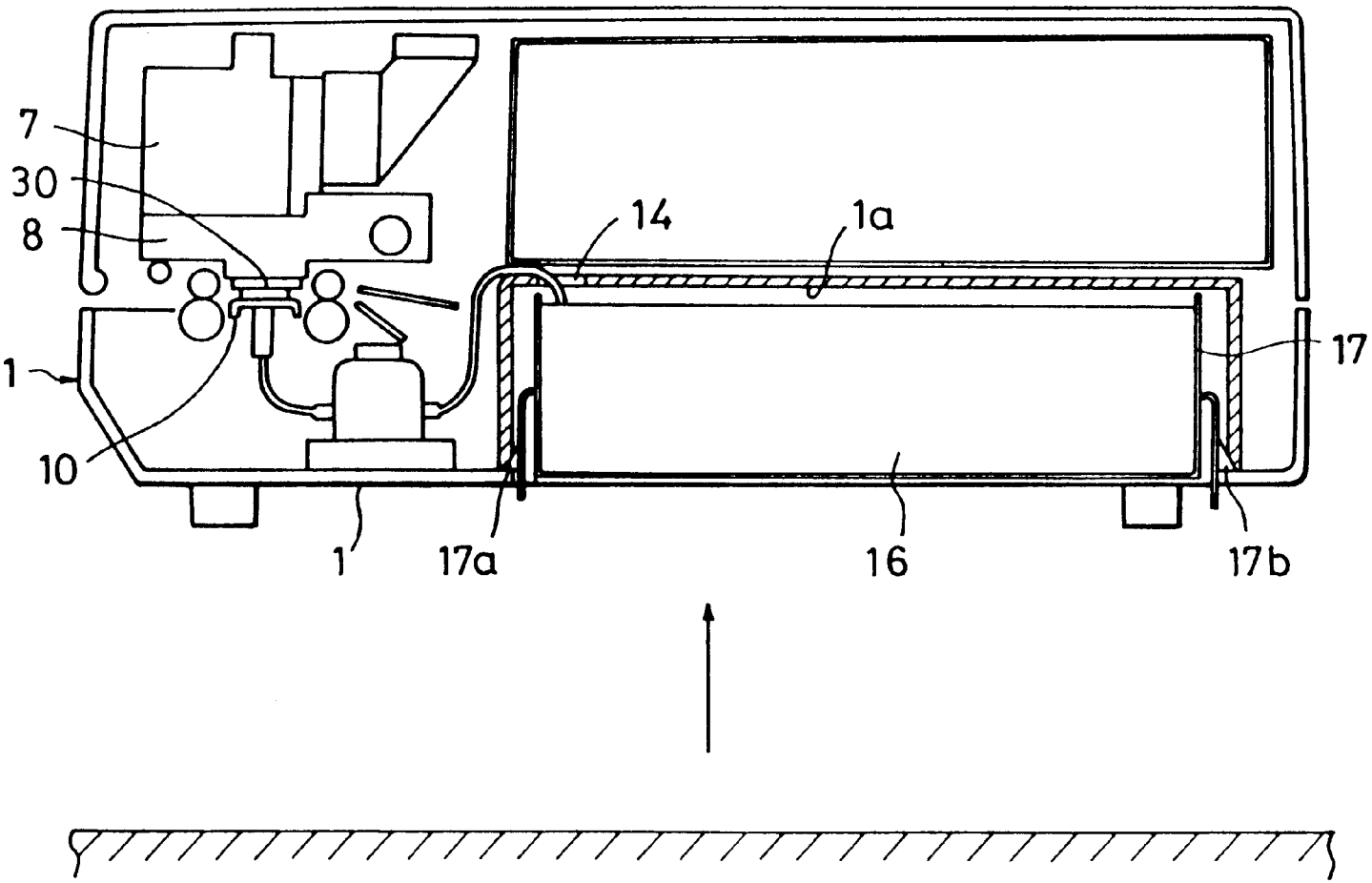
FIG. 13 is a schematic sectional view of a portion of the ink jet recording apparatus showing another example of the construction for mounting the rear cover.

In recent years, the weight of ink jet recording apparatuses has decreased to the point where such apparatuses can easily be lifted. FIG. 13 illustrates an embodiment of the present invention which is especially suited to such a light-weight ink jet recording apparatus. Namely, in this embodiment, the bottom cover 18 used in the first embodiment is eliminated, and the waste ink packs 17 set in the waste ink receiving sections 1*a,* 1*a* are provided with latches 17*a,* 17*b* that engage the lower housing 1.

As will be seen from FIG. 13, the latches 17*a* and 17*b* are provided on the front and rear ends of each waste ink pack 17 and are disengageable through elastic deformation.

More specifically, each of the latches 17*a* and 17*b* has a construction similar to the latch 18*a* provided on the bottom cover 18 used in the first embodiment and can be released in a similar manner. Thus, each waste ink pack can be removed from the lower housing 1 by releasing these latches 17*a* and 17*b.*

In this embodiment, therefore, replacement of the waste ink packs is conducted by manually lifting the whole recording apparatus whenever the packs have become full.

According to the described arrangement, it is not difficult to provide spaces for waste ink receiving sections 1*ab,* 1*cd* of ample volumes. It is therefore possible to install waste ink disposal members 16 of large capacities without requiring enlargement of the size of the apparatus to be increased and the strength of the lower housing 1 to be reduced; thus reducing the frequency with which the waste ink disposal members 16 must be changed.

Although ink jet recording apparatuses of the type using a head cartridge have been described with reference to FIGS. 11 to 13, it will be clear that the present invention can be effectively applied to apparatuses of other types such as the ink-cartridge type.

For instance, the ink jet recording apparatus of the present invention may be of the type in which the recording head or heads are permanently installed and not changed, while the ink supply in the ink tank or tanks is refilled by replacing an ink cartridge or cartridges or by filling a non-removable ink tank with fresh ink through flexible tubing while the head and tank are connected.

The ink clearing recovery method also is illustrative, and the recovery may be conducted by purging stagnant ink by pressurizing the ink supply system.

The ink jet recording apparatuses of the described embodiments are of the type which effects recording using either a single recording head 7 or of a full-color recording type which employs four recording heads 7*a* to 7*d* which discharge inks of different colors. These are not the only types of recording heads that can be used in the present invention, however, and the same advantages as those attained by the described embodiments can also be realized by an ink jet recording apparatus of the gradation recording type which employs a plurality of recording heads which discharge ink of the same color at different densities.

Obviously, the present invention can also be applied to line-printer type ink jet recording apparatus which has discharge openings or nozzles arrayed over the entire width of the recording medium, recording apparatuses of serial-printer type have been specifically described. The invention also can effectively be applied to a copying type recording apparatus which has a function for reading an original image.

The advantages offered by the present invention are remarkable particularly when the invention is applied to an ink jet recording apparatus of the type in which recording is conducted by controlling the formation of ink droplets by making use of thermal energy.

Preferably, such a droplet type ink jet recording apparatus using thermal energy is based upon principles disclosed in U.S. Pat. Nos. 4,723,129 and 4,740,796 and constructed in accordance with the disclosures of these patents. The principles disclosed in these patents are applicable to both on-demand type apparatus and continuous type apparatus. The apparatus of the on-demand type, for example, has the following construction. An electro-thermal transducer holding a recording liquid, i.e., ink, is arranged for each sheet or path. In operation, at least one driving signal is applied to at least one of the transducers at a level high enough to cause a rapid temperature rise avoiding nucleate boiling of the recording liquid. As a consequence, the electro-thermal transducer generates sufficient thermal energy to cause a film boiling of the recording liquid in the region around the heating surface of the recording head, thus forming a bubble of gas in the recording liquid. This type of recording apparatus is particularly useful because the formation of the bubbles can be delicately controlled so that one bubble is generated in response to one driving signal. Expansion and contraction of the bubble generates a force which acts to discharge the recording liquid through the discharge opening into the atmosphere so as to form at least one droplet of the recording liquid. By supplying successive driving signals in the form of pulses, the expansion and contraction of the bubble are effected on real-time basis so as to enable droplets to be discovered with good response to the driving signals. Examples of suitable driving pulse signals are disclosed in U.S. Pat. Nos. 4,463,359 and 4,345,262. The quality of the recording can be further improved by adopting conditions disclosed in U.S. Pat. No. 4,313,124 which is directed to the rate of temperature rise of the above-mentioned heating surface in the recording head.

The construction of the recording head can be suitably determined by suitably designing the features of the discharge openings, liquid paths, i.e., straight or orthogonal, and electro-thermal transducers as these are disclosed in the above-mentioned United States Patents. It is also possible to include a feature disclosed in U.S. Pat. Nos. 4,558,333 and 4,459,600 in which the heating zone is disposed in a curved region of an ink path.

The ink jet recording apparatus of the present invention may be of full-line type in which the recording head has a length corresponding to the width of the largest recording medium which is used on the apparatus. In such a case, the recording head may be composed of a plurality of recording head modules as disclosed in the above-mentioned United States Patents or may be constructed as a unitary recording head. The above-described advantages of the present invention can be enhanced in such a full-line type apparatus regardless of whether the recording head is a unitary head or composed of a plurality of modules.

The recording head used in the ink jet recording apparatus of the present invention may be of the replaceable head type, in which the head has electrical and ink supply systems that can be connected to the main part of the apparatus so that the replaceable head can be supplied with electric power and liquid when connected to the main part of the apparatus, or may be of cartridge type in which an ink supply tank is integrated with the recording head.

In order to optimize the effects produced by the present invention, it is desired to provide the head recovery means and various auxiliary means on the recording apparatus of the present invention. Examples of such means are capping means for capping the recording head, cleaning means for cleaning the recording head after recovery, pressing or sucking means, pre-heating means which may employ the electro-thermal transducer in the ink path or a separate heating element or a combination thereof, and means for performing a preparatory discharge mode of the recording liquid prior to the recording.

The present invention also can be effectively applied to an ink jet recording apparatus of the type which performs recording in a main recording color such as black as well as recording in at least one of a plurality of full colors or a mixed color by using a recording head composed of recording head modules for discharging different color recording liquids or an integral recording head designed to discharge inks of the plural colors.

The ink jet recording apparatus of the present invention may be used as an image output terminal device in information processing system such as a computer, or the recording portion of a copying apparatus having a reader portion, or the recording portion of a facsimile apparatus having transmission/receiving functions.

Figure 14:
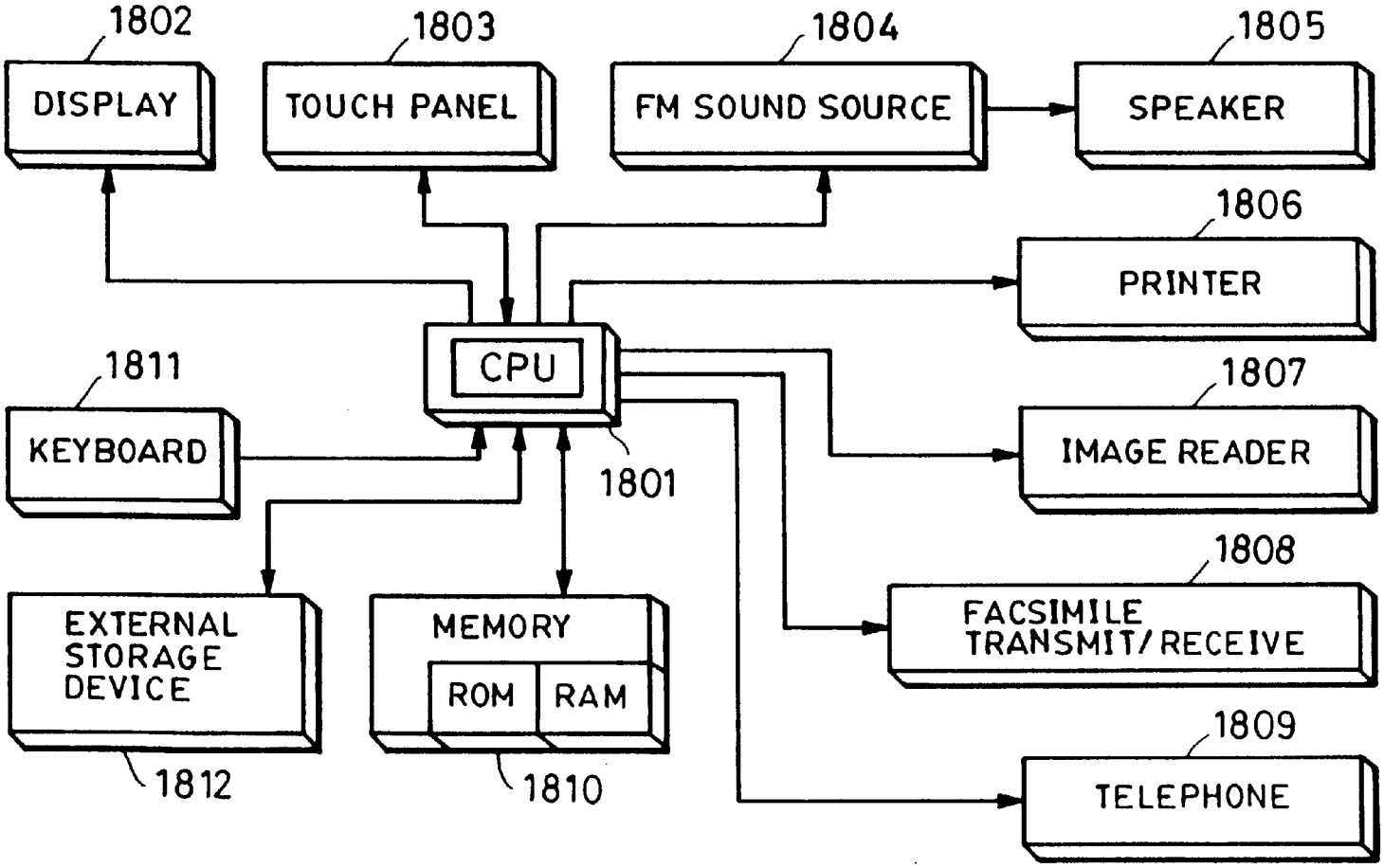
FIG. 14 is a block diagram schematically showing the construction of an information processing apparatus incorporating the ink jet recording apparatus of the present invention.

FIG. 14 is a block diagram of an information processing apparatus having a multiplicity of functions: namely, a word processor, a personal computer, a facsimile and a copying machine.

Referring to this Figure, a control section 1801 for controlling the whole apparatus has a central processing unit such as a microprocessor and various I/O ports for transmitting and receiving various control signals and data signals to and from various portions of the system. The apparatus also has a display section 1802 which displays various menus, document information and image data read by an image reading section 1807. Numeral 1803 denotes a pressure-sensitive type touch panel covering the display section 1802 that enables a user, by pressing with a finger, to enter data by selecting menu items or coordinate positions by pressing regions of the display section 1802 with a finger.

The apparatus further has an FM (Frequency Modulation) sound source which performs a frequency modulation of music information in the form of digital signals read from an internal memory section 1810 or an external storage device 1812 wherein the music information formed by a music editor or the like is stored. The electrical signal from the FM source section 1804 is converted into audible sound by a speaker section 1805. A printer section 1806, which employs an ink jet recording apparatus of the present invention, is used as the common output means for the word processor, personal computer, facsimile apparatus and copying apparatus.

Numeral 1807 designates an image reading section which photoelectrically scans and enters original data. The image reading section 1807 is disposed in the feed path of the original document so as to read the original data to be transmitted through the facsimile apparatus or to be printed by the copying apparatus. A facsimile transmission/receiving section 1807 is adapted for transmitting the original data read by the image reading section 1807 or for decoding facsimile signals sent from another station. Thus, the facsimile transmission/receiving section 1808 has an interface function for connection to external devices. A telephone section 1809 can have various functions such as message keeping function in addition to an ordinary telephone function.

The aforementioned control section 1801 can have a ROM for storing programs including a system program, a manager program and various other programs, as well as character fonts and dictionaries, and a RAM for storing application programs loaded from the external storage device 1812, document information and video information.

A keyboard section 1811 enables the entry of document information and various commands by means of keystrokes.

The external storage device 1812 has a recording medium which may be a floppy disk or a hard disk, and is capable of storing document information, music or voice information and application programs formed by the user.

Figure 15:
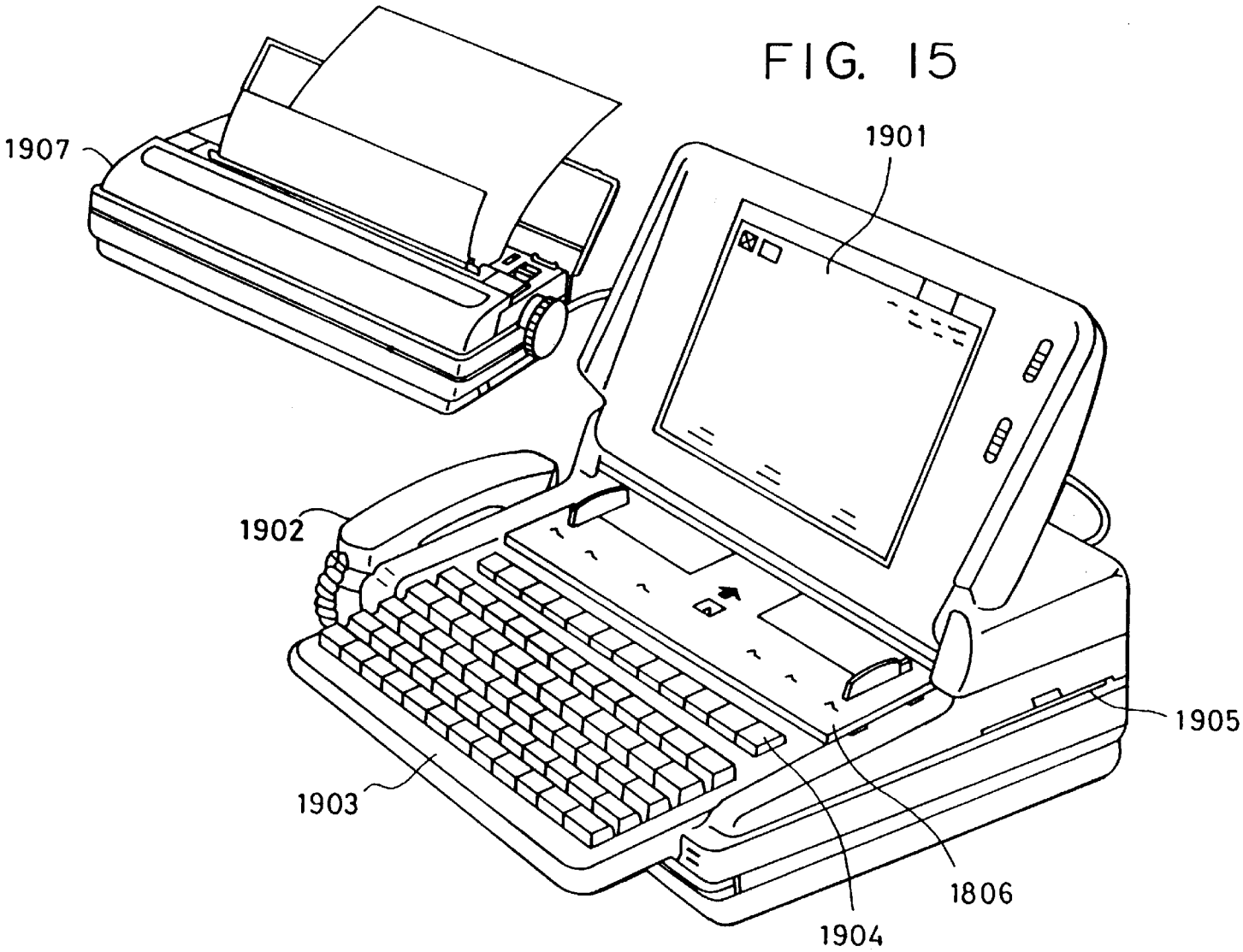
FIG. 15 is a schematic perspective view of the data processing system shown in FIG. 14.

FIG. 15 is a schematic perspective view of the data processing system shown in FIG. 14.

Numeral 1901 denotes a flat display panel of liquid crystal type capable of displaying various menus, pattern information and document information. The aforementioned touch panel 1803 is mounted on the display 1901. The user can select menu items or input coordinate data by pressing the surface of the touch panel 1803. Numeral 1902 denotes a telephone hand set for use when the apparatus is employed in the telephone mode. A keyboard 1903 enables entry of various document information and data and is connected to the main part of the system through cords. The keyboard 1903 also has various function keys 1904. Numeral 1905 denotes an opening through which a floppy disk is loaded in the external storage device 1812.

Numeral 1906 denotes an original table on which an original to be read by the image reading section 1807 is to be placed. After being read the original is ejected from the rear side of the apparatus. When the apparatus is used in facsimile receiving mode, data received from another station is recorded on recording paper by the ink jet printer 1907.

The display section 1802 may be a CRT, although a flat panel using a ferroelectric liquid crystal is preferably used in order to reduce the size, thickness and weight of the display.

When the information processing apparatus is used in personal computer mode or wordprocessor mode, information or data entered through the keyboard section 1811 is processed in accordance with predetermined programs by the control section 1801 and is output as recorded images from the printer section 1806.

In the facsimile receiving mode, facsimile information received from a remote station through the facsimile transmission/receiving section 1808 is processed by the control section 1801 in accordance with a predetermined program and is output from the printer section 1806 as a recorded image.

In the copying mode of operation of the apparatus, an original is read by the image reading section 1807 and the read information is delivered through the control section 1801 to the printer section 1806 so as to be output as a copy image.

In the facsimile transmission mode of operation of the apparatus, the original data read by the image reading section 1807 is processed by the control section 1801 in accordance with a predetermined program and is transmitted to the communication line through the facsimile transmission/receiving section 1808.

Figure 16:
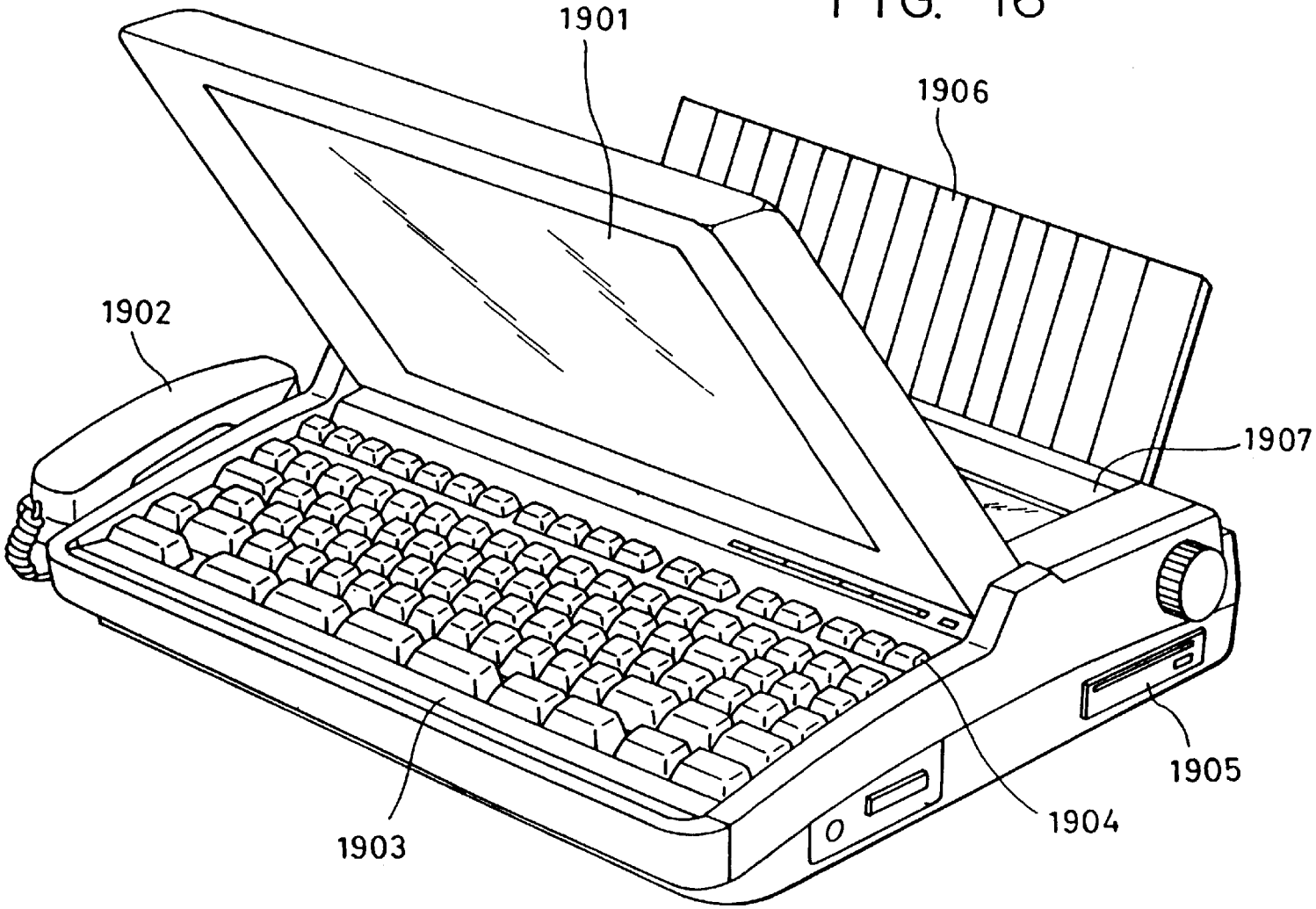
FIG. 16 is a schematic perspective view of an information processing apparatus of integrated type.

The information processing apparatus may be of an integral type incorporating the ink jet printer integrated with the main part of the apparatus as shown in FIG. 16. Such an apparatus has a high degree of portability. In FIG. 16, the same reference numerals are used to denote the same components or parts as those in FIG. 15.

The ink jet recording apparatus of the present invention, incorporated in the multi-function type information processing apparatus described above, further enhances the utility of the apparatus because it allows quiet, high-speed recording of high quality images.

As will be understood from the foregoing description, the present invention offers the following advantages.

Before beginning each recovery cycle, a determination is made as to whether the ink to be cleared by the recovery operation can be safely stored in the waste ink pack without causing an overflow, and a warning is generated if it is determined that the ink to be cleared from the recording head by the recovery operation cannot be received by the waste ink pack without causing overflow. It is therefore possible to eliminate the risk that a recovery operation might be executed clearing ink in excess of the amount that can be contained in the waste ink pack and, hence, avoid contamination of the recording apparatus and/or the recorded image by waste ink overflowing from the waste ink pack.

The amount of the ink collected in the waste ink pack can be determined without using any specific sensing means which would complicate the construction of the recording apparatus and raise the cost of the same.

In a specific embodiment of the invention, a changing preparation signal is given when the waste ink pack becomes nearly full, before a changing signal is given in response to filling of the pack. The user has sufficient warning to prepare a spare waste ink pack and can replace the waste ink pack without delay once the pack is completely filled. Consequently, the unused "down" time is minimized so as to attain higher recording operation efficiency.

It is also to be pointed out that the waste ink receiving section for accommodating the waste ink disposal member is formed by upwardly recessing the bottom wall of the lower housing of the apparatus at a position near the space for accommodating a stack of the recording medium. It is therefore possible to provide a space large enough to accommodate an ample waste ink receiving section by utilizing the dead space in the apparatus. This makes it possible to use a large waste ink disposal member without requiring an increase in the size of the apparatus or a reduction in the strength of the lower housing, thus remarkably reducing the frequency with which the waste ink disposal member must be changed.

In a specific form of the invention, a plurality of waste ink receiving sections are provided in the apparatus, making it possible to hold a large amount of waste ink in the apparatus without requiring the size of the apparatus to be increased. By designing the apparatus such that the line interconnecting a pair of handles attached to the housing of the apparatus is parallel to the line interconnecting two spaced-apart waste ink receiving sections, it is possible to obtain a good balance of the apparatus when the apparatus is handled, regardless of the amount of waste ink collected in these waste ink receiving sections.

What is claimed is:

1. An ink jet recording apparatus comprising:

a plurality of ink jet recording heads for executing color recording; and a recovery structure for maintaining and recovering a discharge state with respect to said plurality of recording ink jet recording heads;

wherein said recovery structure has a first waste ink collecting route connecting a predetermined one of said ink jet recording heads and a first waste ink tank that collects waste ink discharged from said predetermined ink jet recording head, and a second waste ink collecting route connecting all remaining ones of said plurality of ink jet recording heads and a second waste ink tank that collects waste ink discharged from said remaining ink jet recording heads, said second waste ink collecting route being completely separate from said first waste ink collecting route.

2. An ink jet recording apparatus according to claim 1, wherein black, yellow, cyan and magenta inks are used for said color recording, and said predetermined kind of waste ink is ink which is used most frequently and the other plural kinds of waste ink are kinds of ink other than the ink which is used most frequently.

3. An ink jet recording apparatus according to claim 1, wherein black, yellow, cyan and magenta inks are used for said color recording, and said predetermined kind of waste ink is black ink and the other plural kinds of waste ink are yellow, cyan and magenta inks.

4. An ink jet recording apparatus comprising:

a plurality of ink jet recording heads;

a recovery structure for maintaining and recovering a discharge state with respect to said plurality of recording heads; and one waste ink collecting container for collecting waste ink discharged from said recovery structure, wherein said recovery structure has a plurality of waste ink collecting routes to said collecting container in accordance with the plurality of recording heads, and said plurality of waste ink collecting routes are disposed so as to discharge to different portions of said waste ink collecting container.

* * * * *